US005529418A

United States Patent [19]

Alotta

[11] Patent Number: 5,529,418

[45] Date of Patent: Jun. 25, 1996

[54] BINDER FOR PLANNING CALENDAR/APPOINTMENT BOOK AND KIT

[76] Inventor: Sylvia R. Alotta, 516 Shelton St., Charlotte, N.C. 28270

[21] Appl. No.: 509,163

[22] Filed: Jul. 31, 1995

[51] Int. Cl.[6] ..... B42F 13/00

[52] U.S. Cl. ..... 402/73; 281/29; 281/36; 281/37

[58] Field of Search ..... 281/15.1, 21.1, 281/29, 36, 37, 51; 402/70, 73, 80 R

[56] References Cited

U.S. PATENT DOCUMENTS

| | | | |
|---|---|---|---|
| 4,487,430 | 12/1984 | Bennandin | 281/29 |
| 4,575,273 | 3/1986 | Genniet | 402/73 X |
| 4,744,689 | 5/1988 | Stenuberg | 402/73 |
| 5,042,841 | 8/1991 | Friedman | 281/29 |
| 5,378,022 | 1/1995 | French et al. | 281/29 X |

*Primary Examiner*—Willmon Fridie, Jr.
*Attorney, Agent, or Firm*—Marshall, O'Toole, Gerstein, Murray & Borun

[57] ABSTRACT

In order to personalize a product of the planning calendar/appointment book type, a binder is disclosed having a flexible cover with top, bottom, and a pair of opposed side edges in a flat, unfolded position. The cover has a plurality of pairs of holes disposed along at least one, and preferably a pair, of hole-locating axes extending generally between the top and bottom edges in parallel relation to one another. The hole-locating axes are disposed generally to one side of and parallel to a cover bisecting axis but nearer the cover bisecting axis than a nearest one of the opposed side edges of the cover. The binder kit also includes a plurality of separate binding components, a flexible cord, and a button-like fastener. The binding components may comprise rings each of which is adapted to be associated with one of the pairs of holes in the cover for binding an insert to the cover. The flexible cord has a pair of loose ends to be secured to the cover at a point generally intermediate the opposed side edges of the cover. With this particular arrangement which may be provided in kit form, the button-like fastener has a central aperture to be secured to an end of the flexible cord opposite the loose ends to cooperate with a slit in the cover.

20 Claims, 5 Drawing Sheets

BINDER FOR PLANNING CALENDAR/APPOINTMENT BOOK AND KIT

FIELD OF THE INVENTION

The present invention is generally directed to insert binders and, more particularly, a binder and kit for creating a personalized binder system.

BACKGROUND OF THE INVENTION

Over the years, there have been a wide variety of different products for binding inserts within a binder. These products have taken on various different forms depending upon the particular application and the materials to be bound as inserts. By way of example, there have been planning calendars, appointment books, photo albums, and notebooks.

As will be appreciated, the binders in question are similar in that they all serve to bind an insert. The insert may typically comprise some form of paper product and, in many instances, the paper product may have holes punched in a preselected arrangement and spacing. While useful for their intended purpose, the binders that have existed are not capable of being truly personalized.

In any effort to personalize binders, it is important that the binder remain fully capable of performing its intended function. It is also highly desirable for marketing purposes that the binder have certain specific characteristics which render it immediately recognizable to consumers while at the same time making it possible for the consumer to personalize a binder system by essentially creating a unique binder. Until the present invention, there has been no truly personal binder system capable of such "creative personalization."

The present invention is directed to overcoming one or more of the foregoing problems and achieving one or more of the resulting objects.

SUMMARY OF THE INVENTION

It is a principal object of the present invention to provide a unique binder and binder kit. It is another object of the present invention to provide such a binder and binder kit that allows for creating a truly personalized personal binder system. It is a further object of the present invention to provide a binder and binder kit with interchangeable components.

Accordingly, the present invention is directed to a binder having a flexible cover with top, bottom, and a pair of opposed side edges in a flat, unfolded position and having a plurality of holes disposed along a hole-locating axis. The hole-locating axis extends generally between the top and bottom edges of the cover. Still additionally, the hole-locating axis is disposed generally to one side of a cover bisecting axis but generally nearer the cover bisecting axis than a nearest one of the opposed side edges of the cover.

Also, the binder includes means associated with the holes in the cover for binding an insert to the cover in a manner accommodating folding movement of a first side portion of the cover about a first cover fold region front the flat, unfolded position to a folded position overlying the cover bisecting axis. The first cover fold region is generally adjacent the hole-locating axis and the cover also has a second cover fold region generally adjacent the side edge of the first side portion after the first side portion has been folded into the folded position. In this connection, the second cover fold region accommodates folding movement of a second side portion of the cover from the flat, unfolded position to a folded position overlying the cover bisecting axis so as to also be in at least partially overlapping relation to the first side portion in the folded position.

Further, the binder includes flexible cord means having a first end secured to the cover at a point which is generally intermediate the first and second side portions of the cover at a point between the first and second cover fold regions thereof. The first and second fold regions define a rear of the binder therebetween to which the first end of the flexible cord means is secured and the flexible cord means also has a second end remote from the first end and is of a length to extend about the first cover fold region to a front of the binder in confronting relation to the second side portion of the cover. With this arrangement, the binder includes means for releasably securing the second end of the flexible cord means to the second side portion to maintain the cover in the folded position with the second side portion at least partially overlapping the first side portion.

In the exemplary embodiment, the flexible cover has a second plurality of holes disposed along a second hole-locating axis extending generally between the top and bottom edges and also disposed generally to the one side of the cover bisecting axis but nearer the cover bisecting axis than the nearest one of the opposed side edges of the cover. The hole-locating axes are preferably disposed in generally parallel relation with the holes being located along the hole-locating axes in corresponding pairs and in spaced apart relation such that the corresponding pairs of holes generally define the first cover fold region therebetween. As for other details, the binding means comprises a separate binding ring operatively associated with each of the corresponding pairs of holes for binding an insert to the cover, and the rings have a diameter at least as great as the distance between the corresponding pairs of holes to accommodate unfolding movement of the first cover portion to a generally flat, unfolded position.

In a highly preferred embodiment, the cover has a pair of slits generally in the region of the cover bisecting axis with the first end of the flexible cord means being secured to the slits and comprising a pair of loose ends of a cord extending through the slits in the cover and tied between the from and rear of the binder when the cover is in the folded position thereof. The cover also has a slit generally adjacent the side edge of the second cover portion and the second end of the flexible cord means has a button-like fastener thereon having a diameter no greater than the length of the slit in the second cover portion to pass through the slit in the second cover portion from one side to the other to be visible from the front of the binder. Further, the button-like fastener is generally circular in shape and has a central aperture for securing the second end of the flexible cord means thereto with the loose ends of the cord being passed through the central aperture and through a loop defined by the remainder of the cord to form a secure looped interconnection of the cord with the button-like fastener.

In a most highly preferred embodiment of the invention, the button-like fastener comprises a medallion having a single square central aperture. The cover also preferably has a slit generally adjacent the side edge of the second cover portion together with a square-shaped hole at each of opposite ends thereof. Still additionally, the corresponding pairs of holes which receive the rings and which are disposed along the hole-locating axes are preferably square in shape.

In another respect, the present invention is directed to a binder kit including a flexible cover, a flexible cord, a button-like fastener, and a plurality of separate binding means. The flexible cover is preferably formed of a soft, pliable material to accommodate repeated folding and unfolding movement thereof and, similarly, the flexible cord is also formed of a soft, pliable material to accommodate repeated fastener cooperation with the slit in the cover. Also, and as with the binder, the binding means comprise binding rings and the button-like fastener comprises a medallion, both of which may be formed of metal.

Other objects, advantages and features of the present invention will become apparent from a consideration of the following specification taken in conjunction with the accompanying drawings.

DETAILED DESCRIPTION OF THE PREFERRED EMBODIMENT

Figure 2:
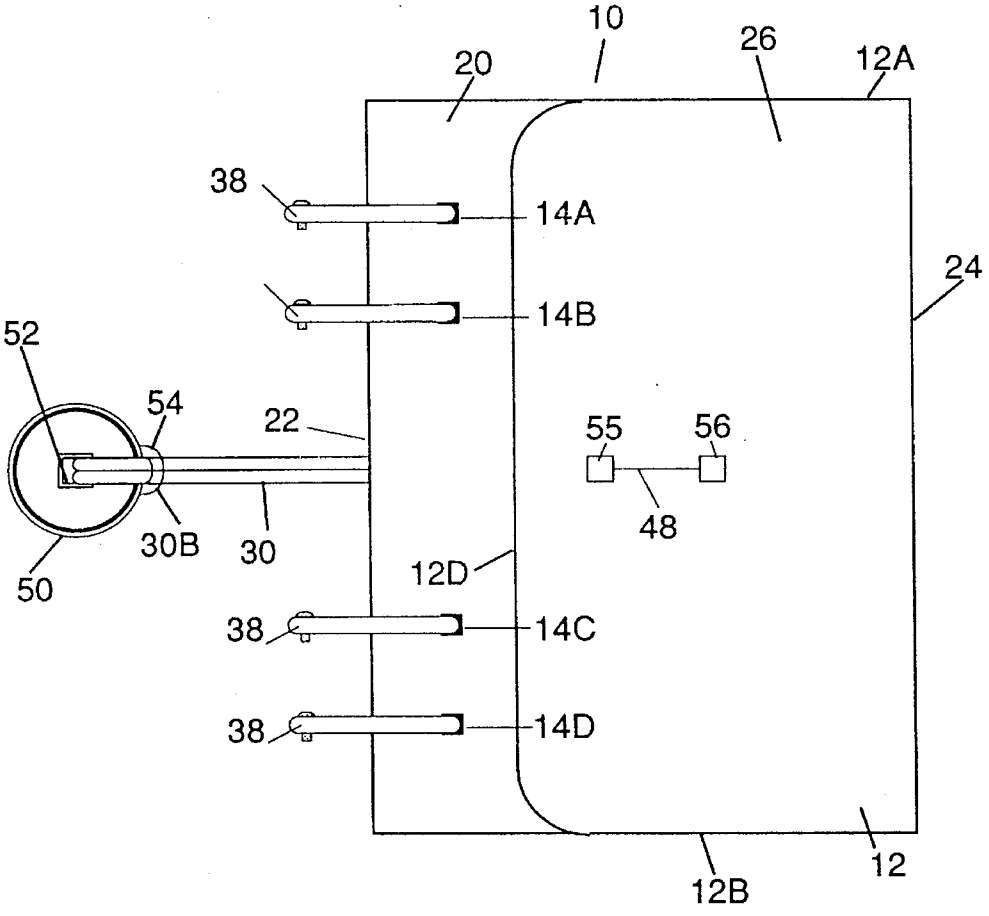
FIG. 2 shows a first step in opening the binder which is illustrated in FIG. 1.

In the illustrations given, and with references to FIGS. 1–4 of the drawings, the reference numeral 10 designates generally a binder in accordance with the present invention. The binder 10 includes a flexible cover 12 having a top edge 12*a*, a bottom edge 12*b*, and a pair of opposed side edges 12*c* and 12*d* in a flat, unfolded position and a plurality of holes 14*a–d* disposed along a hole-locating axis 16 (see FIG. 5). The hole-locating axis 16 will be seen and understood to extend generally between and perpendicular to the top and bottom edges 12*a* and 12*b* of the cover 12. With this arrangement, and as shown, the hole-locating axis 16 is disposed generally to one side of a cover bisecting axis 18 but nearer the cover bisecting axis 18 than a nearest one 12*c* of the opposed side edges of the cover 12.

As shown in FIGS. 1–6, the binder 10 includes means associated with the holes 14*a–*14*d* in the cover 12 for binding an insert to the cover 12 in a manner accommodating folding movement of a first side portion 20 of the cover 12 about a first cover fold region 22 from the flat, unfolded position to a folded position overlying the cover bisecting axis 18. The first cover fold region 22 is generally adjacent the hole-locating axis 16 and the cover 12 also has a second cover fold region 24 generally adjacent the side edge 12*c* of the first side portion 20 after the first side portion 20 has been folded into the folded position (compare FIGS. 3 and 5). With this arrangement, the second cover fold region 24 accommodates folding movement of a second side portion 26 of the cover 12 from the flat, unfolded position to a folded position overlying the cover bisecting axis 18 so as to also be in at least partially overlapping relation to the first side portion 20 in the folded position.

Figure 1:
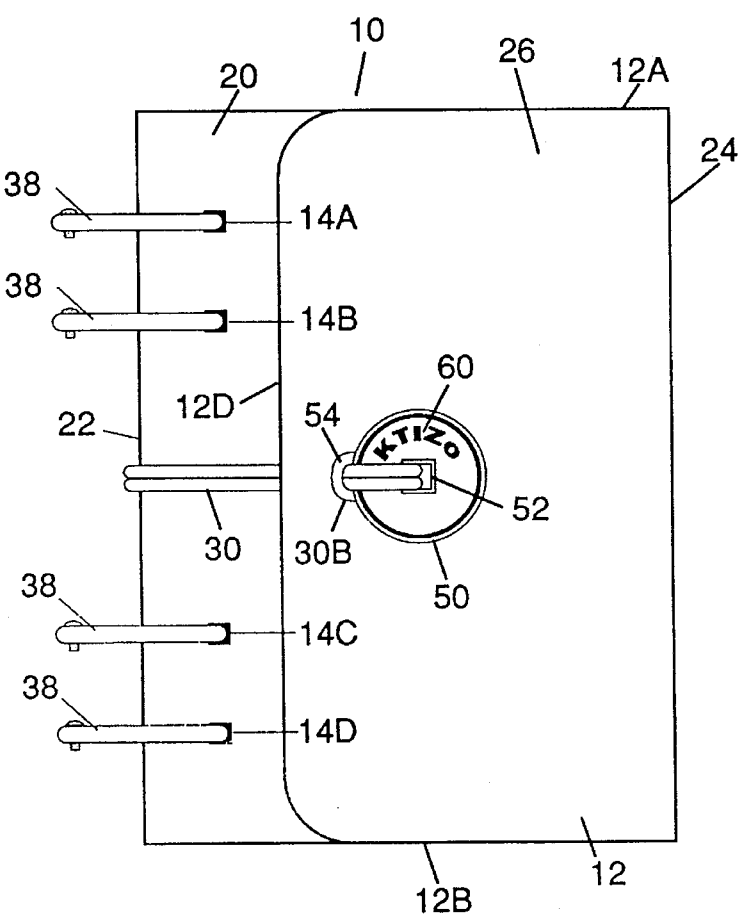
FIG. 1 is a front elevational view of a binder in accordance with the present invention.
Figure 3:
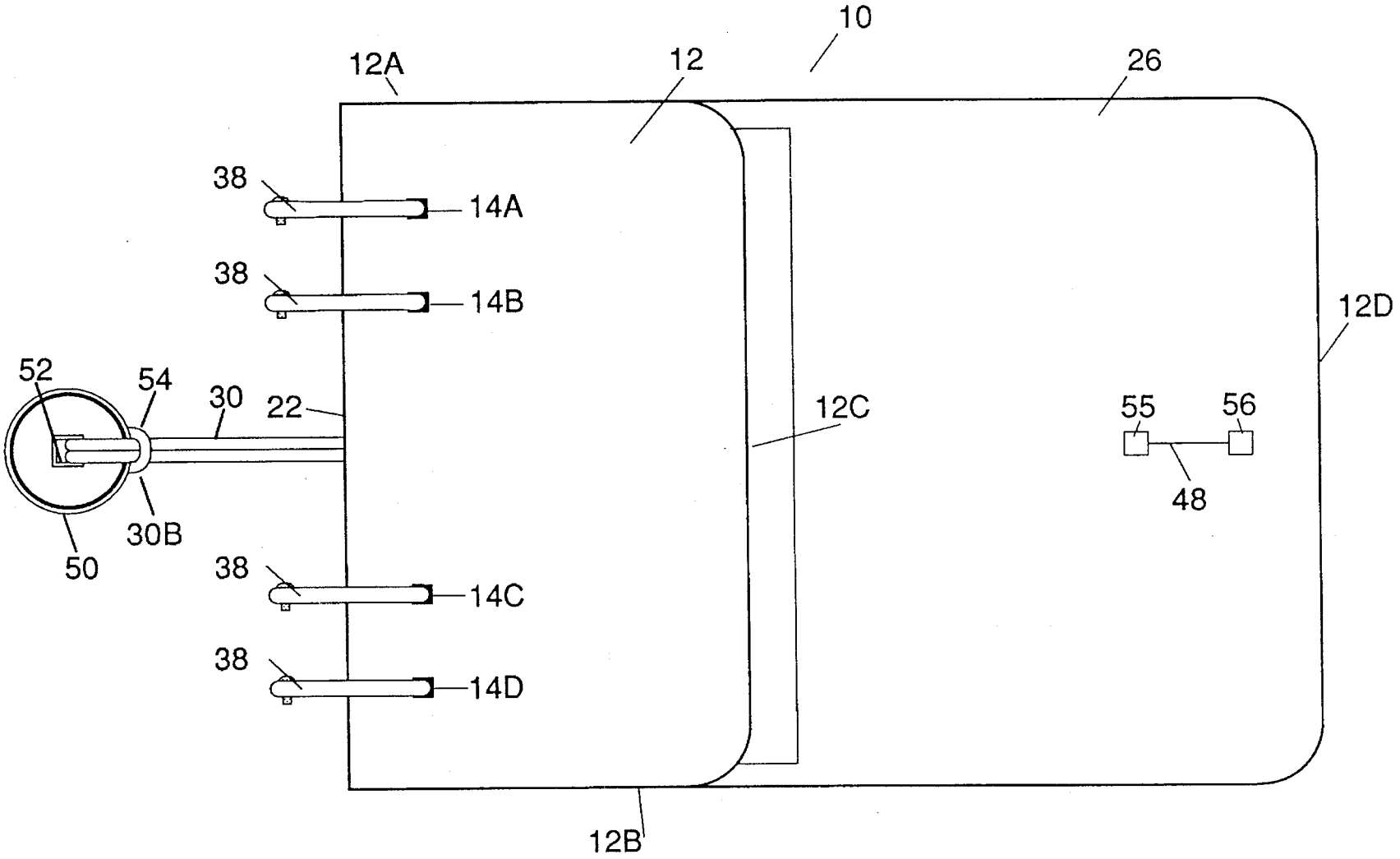
FIG. 3 shows a second step in opening the binder which is illustrated in FIG. 1.
Figure 4:
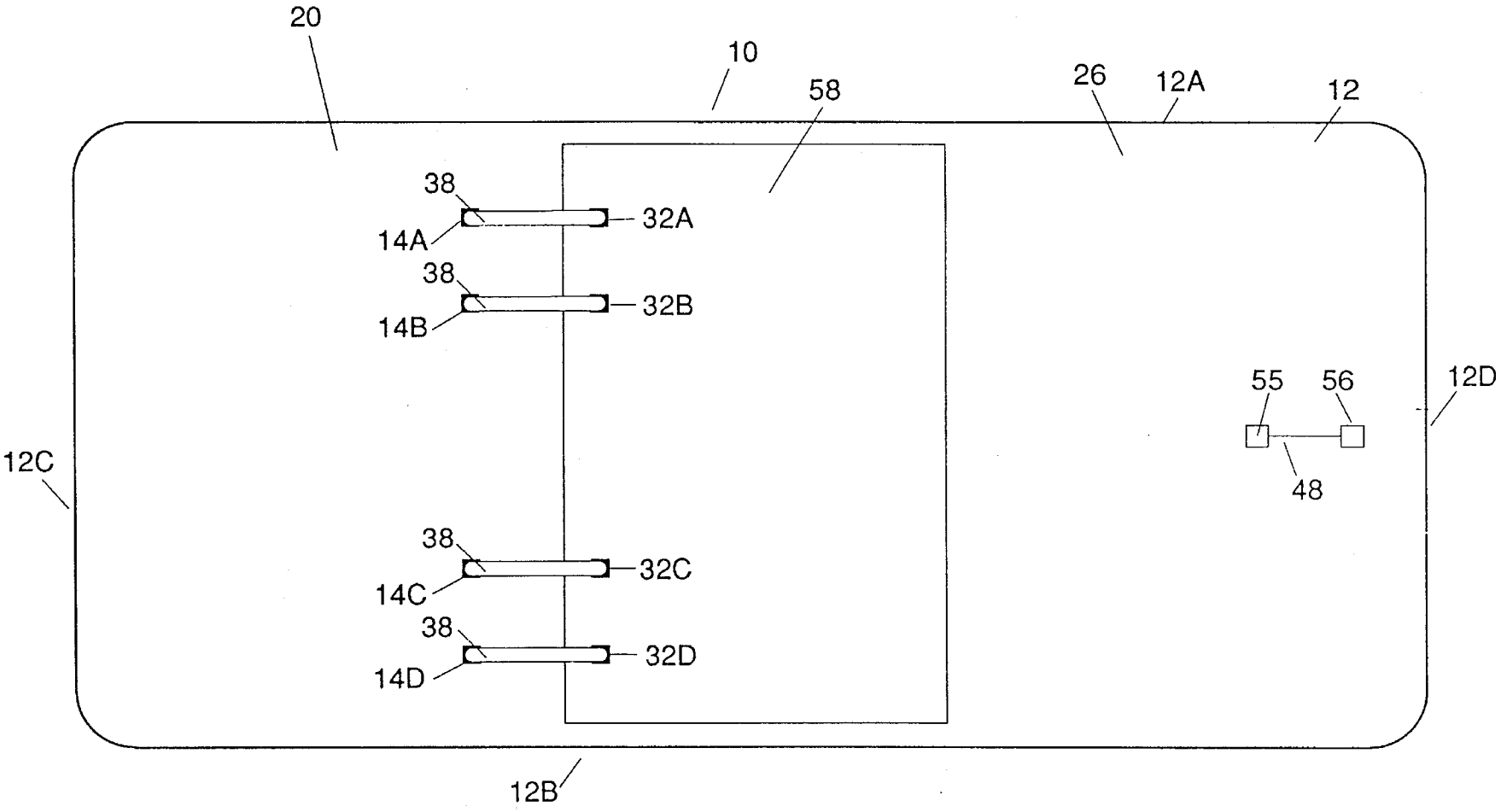
FIG. 4 shows a third step in opening the binder which is illustrated in FIG. 1.
Figure 5:
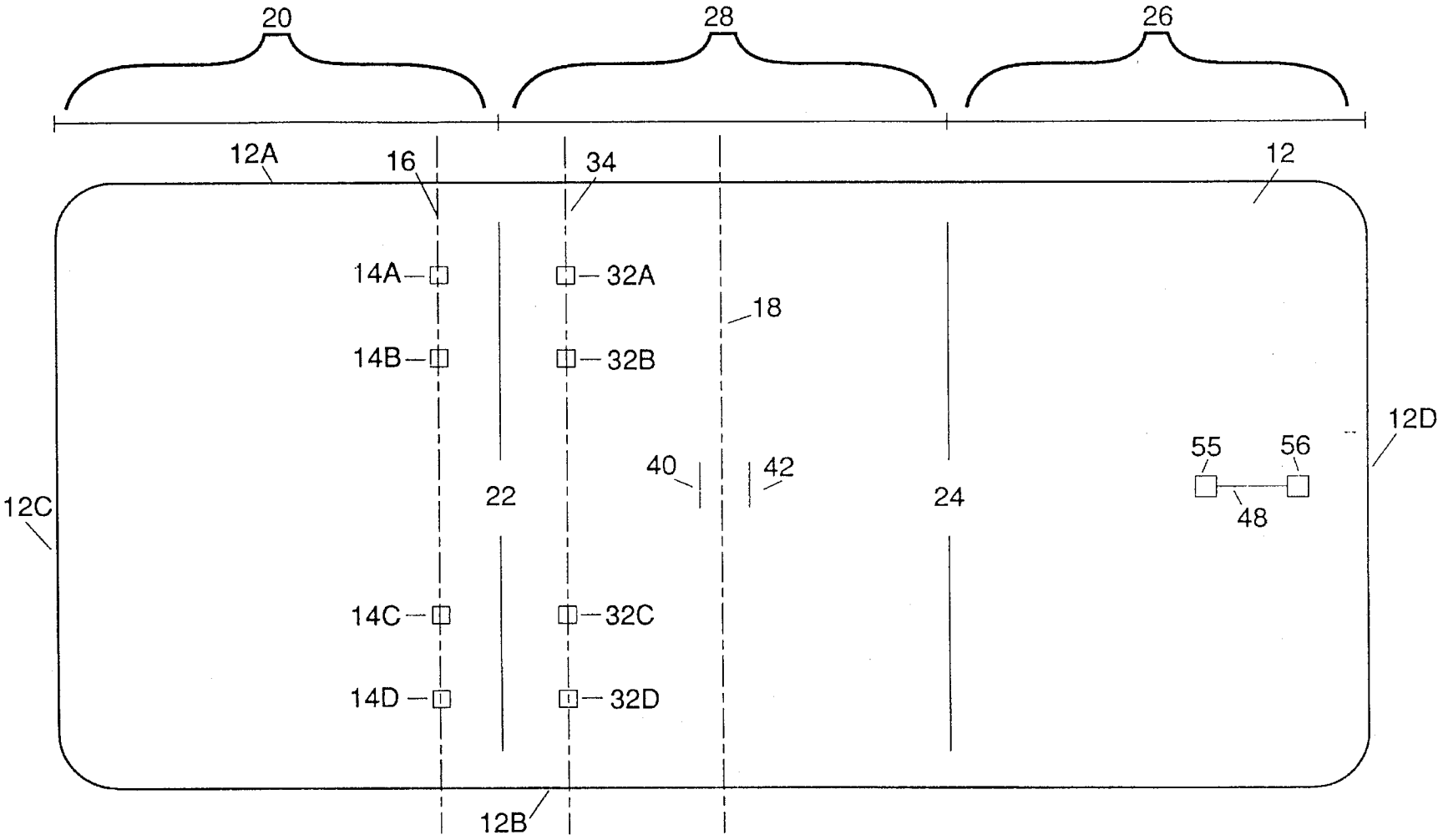
FIG. 5 is a top plan view of a flexible cover for the binder illustrated in FIG. 1.

Referring specifically to FIG. 1, the first and second side portions 20 and 26 define a front of the binder 10 when folded into the folded positions thereof and the remainder 28 of the cover 12 defines a rear of the binder 10 when folded into the folded positions thereof (see, also, FIG. 5).

Figure 6:
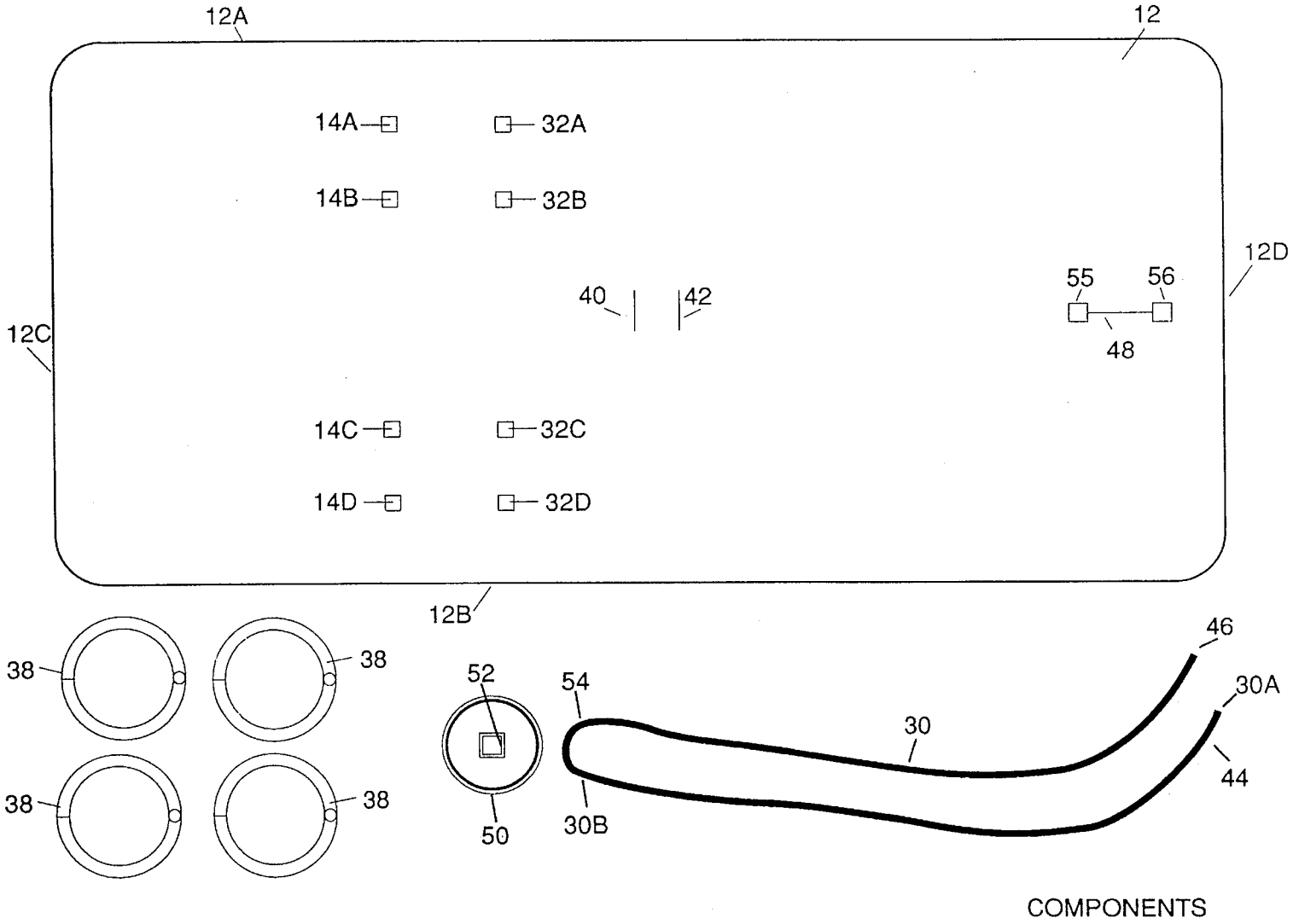
FIG. 6 is a top plan view of the components of a binder kit in accordance with the present invention.

Referring to FIG. 6, the binder 10 will be understood to have a flexible cord generally designated 30 having a first end as at 30*a* to be secured to the cover 12 intermediate the first and second side portions 20 and 26 of the cover 12 at a point between the first and second cover fold regions 22 and 24 thereof. The first and second cover fold regions 22 and 24 define the rear 28 of the binder 10 therebetween, as previously mentioned, to which the first end as at 30*a* of the flexible cord 30 is secured and the flexible cord 30 also has a second end as at 30*b* remote from the first end as at 30*a* and of a length to extend about the first cover fold region 22 to the front of the binder 10 in confronting relation to the second side portion 26 of the cover 12. As will also be appreciated, the binder 10 includes means for releasably securing the second end 30*b* of the flexible cord 30 to the second side portion 26 to maintain the cover 12 in the folded position with the second side portion 26 from at least partially overlapping the first side portion 20.

Referring to FIGS. 5 and 6, the flexible cover 12 preferably has a second plurality of holes 32*a–*32*d* disposed along a second hole-locating axis 34 extending generally between and perpendicular to the top and bottom edges 12*a* and 12*b* of the cover 12. The second hole-locating axis 34 is also disposed generally to the one side of the cover bisecting axis 18 but nearer the cover bisecting axis 18 than the nearest one of the opposed side edges 12*c* of the cover 12. The hole-locating axes 16 and 34 are in generally parallel relation with the holes being located along the hole-locating axes 16 and 34 in corresponding pairs, e.g., 14*a–*32*a*, 14*b–*32*b*, etc. The hole-locating axes 16 and 34 are disposed in spaced apart relation such that the corresponding pairs of holes 14*a–*32*a*, 14*b–*32*b*, etc. are in spaced apart relation to define the first cover fold region 22 therebetween. The binding means comprises a separate binding ring 38 operatively associated with each of the corresponding pairs of holes 14*a–*32*a*, 14*b–*32*b*, etc. for binding an insert to the cover 12. Preferably, the separate binding rings 38 each have a diameter at least as great as the distance between the corresponding pairs of holes 14*a–*32*a*, 14*b–*32*b*, etc. to accommodate unfolding movement of the first cover portion 20 to a generally flat, unfolded position (see FIG. 4).

As for other details of the binder 10, the cover 12 has a pair of slits 40 and 42 generally in the region of the cover bisecting axis 18 with the first end 30*a* of the flexible cord 30 being secured to the cover 12 through the slits 40 and 42. The first end 30a of the flexible cord 30 comprises a pair of loose ends 44 and 46 that extend through the slits 40 and 42 in the cover 12 and are tied between the front and rear of the binder 10 when the cover 12 is in the folded position thereof. The cover 12 also has a slit 48 generally adjacent the side edge 12*d* of the second cover portion 26 and the second end 30*b*of the flexible cord 30 has a button-like fastener 50 thereon. The button-like fastener 50 has a diameter no greater than the length of the slit 48 in the second cover portion 26 to pass through the slit 48 in the second cover portion 26 from one side to the other to be visible from the front of the binder 10. The button-like fastener 50 is generally circular in shape and has a central aperture 52 for securing the second end 30*b* of the flexible cord 30 thereto. As will be appreciated from FIG. 1, the loose ends 44 and 46 of the cord 30 are passed through the central aperture 52 and through a loop 54 defined by the remainder of the cord 30 in order to form a secure, looped interconnection of the cord 30 with the button-like fastener 50.

In the preferred embodiment, the button-like fastener comprises a medallion having a single square central aperture 52 for securing the second end 30*b* of the flexible cord 30 thereto. It will also be noted that the corresponding pairs of holes 14*a*–32*a*, 14*b*–32*b*, etc. disposed along the hole-locating axes 16 and 34 are square in shape and generally of the same or a closely similar size as the single square central aperture 52 in the medallion 50. Still additionally, the preferred embodiment incorporates a pair of square-shaped holes 55 and 56 as a portion of the slit 48 at each of opposite ends thereof.

With the foregoing arrangement, the binder 10 comprises a product, system, or kit having a number of unique attributes. The simple, straightforward makeup of the binder 10 is evident from FIGS. 5 and 6 which makes it clear that there are only four types of constituent components that make up the entirety of the binder 10 and only a total of seven total pieces, and yet the binder 10 is capable of performing its intended function in a highly effective manner while at the same time allowing for significant personalization. With this unique binder kit of the invention, the consumer can essentially "create" a binder that is personalized yet follows a recognized product image.

In particular, the binder 10 is well suited for marketing and selling in a variety of ways that will now be apparent to those of ordinary skill in the art. It accommodates existing paper products 58 due to the number and spacing of the holes 14*a*–32*a*, 14*b*–32*b*, etc. and looseleaf rings 38 or, alternatively, screwposts (not shown) can be provided in a wide variety of colors, textures, shapes and sizes which can all be the same for a given binder 10 or can be of different, contrasting colors, textures, etc. as desired. Still additionally, the holes 14*a*–32*a*, 14*b*–32*b*, etc. can be of the same size and shapes as the holes 52, 55 and 56 to add to the uniqueness of appearance of the binder 10.

As for the medallion 50, this provides a truly unique manner of displaying a logo 60 that is representative of the entire product line. Thus, while the cover 12 can be manufactured in materials such as leather, plastic, vinyl, rubber, etc. and can have a multitude of patterns or images screened on or imprinted on the outer surface in various different colors, the medallion 50 can present a consistent logo 60 representative of the product line and clearly identifying it to consumers. As another element, the cord 30 can be provided in a variety of materials, textures, and colors to further add to the possibilities for personalization.

As will be appreciated from the foregoing, the present invention is well suited for product marketing as a binder kit with the components of the kit being understood from FIG. 6. It includes a flexible cover 12 having a plurality of pairs of holes 14*a*–32*a*, 14*b*–32*b*, etc. disposed along a pair of hole-locating axes 16 and 34 generally to one side of and parallel to the cover bisecting axis 18, and it also includes a plurality of separate binding means such as the loose leaf binding rings 38, each of which has means for opening and dosing the rings for binding an insert such as paper 58 to the cover 12 which may be of a conventional looseleaf type well known to those skilled in the art. As for other aspects of the binder kit, it will include a flexible cord 30 and a button-like fastener 50 having a central aperture to be secured to the cord 30.

In still other respects, the flexible cover 12 is advantageously formed of a soft, pliable material to accommodate repeated folding and unfolding movement thereof. It is also advantageous for the flexible cord 30 to be formed of a soft, pliable material to accommodate repeated fastener cooperation with the slit 48 and the cover 12. Finally, the button-like fastener comprising the medallion 50 and the binding means comprising the binding rings 38 may advantageously be formed of plastic or metal.

While in the foregoing there has been set forth a preferred embodiment of the invention, it will be appreciated that the details herein given may be varied by those skilled in the art without departing from the true spirit and scope of the appended claims.

I claim:

1. A binder, comprising:

a flexible cover having top, bottom, and a pair of opposed side edges in a flat, unfolded position and having a plurality of holes disposed along a hole locating axis, said hole locating axis extending generally between said top and bottom edges, said hole locating axis being disposed generally to one side of a cover bisecting axis but nearer said cover bisecting axis than a nearest one of said opposed side edges of said cover;

means associated with said holes in said cover for binding an insert to said cover in a manner accommodating folding movement of a first side portion of said cover about a first cover fold region from said flat, unfolded position to a folded position overlying said cover bisecting axis, said first cover fold region being generally adjacent said hole locating axis and said cover also having a second cover fold region generally adjacent said side edge of said first side portion after said first side portion has been folded into said folded position, said second cover fold region accommodating folding movement of a second side portion of said cover from said flat, unfolded position to a folded position overlying said cover bisecting axis so as to also be in at least partially overlapping relation to said first side portion in said folded position;

said first and second side portions defining a front of said binder when folded into said folded positions thereof;

flexible cord means having a first end secured to said cover at a point intermediate said first and second side portions of said cover at a point between said first and second cover fold regions thereof, said first and second fold regions defining a rear of said binder therebetween to which said first end of said flexible cord means is secured and said flexible cord means also having a second end remote from said first end and of a length to extend about said first cover fold region to said front of said binder in confronting relation to said second side portion of said cover, and means for releasably securing said second end of said flexible cord means to said second side portion to maintain said cover in said folded position with said second side portion at least partially overlapping said first side portion.

2. The binder of claim 1 wherein said flexible cover has a second plurality of holes disposed along a second hole locating axis extending generally between said top and bottom edges, said second hole locating axis also being disposed generally to said one side of said cover bisecting axis but nearer said cover bisecting axis than said nearest one of said opposed side edges of said cover.

3. The binder of claim 2 wherein said hole locating axes are disposed in generally parallel relation with said holes being located along said hole locating axes in corresponding pairs, said hole locating axes being disposed in spaced apart relation such that said corresponding pairs of holes are disposed in spaced apart relation to define said first cover fold region therebetween.

4. The binder of claim 3 wherein said binding means comprises a separate binding ring operatively associated with each of said corresponding pairs of holes for binding an insert to said cover, said separate binding rings having a diameter at least as great as the distance between said holes in each of said corresponding pairs of holes to accommodate unfolding movement of said first cover portion to a generally flat, unfolded position.

5. The binder of claim 1 wherein said cover has a pair of slits generally in the region of said cover bisecting axis with said first end of said flexible cord means being secured to said slits, said first end of said flexible cord means comprising a pair of loose ends of a cord extending through said slits in said cover and being tied between said from and rear of said binder when said cover is in said folded position thereof.

6. The binder of claim 5 wherein said cover has a slit generally adjacent said side edge of said second cover portion and said second end of said flexible cord means has a button-like fastener thereon, said button-like fastener having a diameter no greater than the length of said slit in said second cover portion to pass through said slit in said second cover portion from one side to the other to be visible from said front of said binder.

7. The binder of claim 6 wherein said button-like fastener is generally circular in shape and has a central aperture for securing said second end of said flexible cord means thereto, said loose ends of said cord being passed through said central aperture and through a loop defined by the remainder of said cord in order to form a secure looped interconnection of said cord with said button-like fastener.

8. A binder, comprising:

a flexible cover having top, bottom, and a pair of opposed side edges in a flat, unfolded position and having a plurality of holes disposed along a hole locating axis, said hole locating axis extending generally between said top and bottom edges, said hole locating axis being disposed generally to one side of a cover bisecting axis but nearer said cover bisecting axis than a nearest one of said opposed side edges of said cover;

said flexible cover having a second plurality of holes disposed along a second hole locating axis extending generally between said top and bottom edges and disposed generally to said one side of said cover bisecting axis but disposed so as to be nearer said cover bisecting axis than said nearest one of said opposed side edges of said cover;

means associated with said holes in said cover for binding an insert to said cover in a manner accommodating folding movement of a first side portion of said cover about a first cover fold region from said flat, unfolded position to a folded position overlying said cover bisecting axis, said first cover fold region being generally adjacent said hole locating axis and said cover also having a second cover fold region generally adjacent said side edge of said first side portion after said first side portion has been folded into said folded position, said second cover fold region accommodating folding movement of a second side portion of said cover from said flat, unfolded position to a folded position overlying said cover bisecting axis so as to also be in at least partially overlapping relation to said first side portion in said folded position;

said first and second side portions defining a front of said binder when folded into said folded positions thereof;

flexible cord means having a first end secured to said cover at a point intermediate said first and second side portions of said cover at a point between said first and second cover fold regions thereof, said first and second fold regions defining a rear of said binder therebetween to which said first end of said flexible cord means is secured and said flexible cord means also having a second end remote from said first end and of a length to extend about said first cover fold region to said front of said binder in confronting relation to said second side portion of said cover, and means for releasably securing said second end of said flexible cord means to said second side portion to maintain said cover in said folded position with said second side portion at least partially overlapping said first side portion;

said cover having a pair of slits generally in the region of said cover bisecting axis with said first end of said flexible cord means comprising a pair of loose ends of a cord extending through said slits in said cover and tied between said front and rear of said binder when said cover is in said folded position thereof.

9. The binder of claim 8 wherein said hole locating axes are disposed in generally parallel relation with said holes being located along said hole locating axes in corresponding pairs, said hole locating axes being disposed in spaced apart relation such that said corresponding pairs of holes are disposed in spaced apart relation to define said first cover fold region therebetween.

10. The binder of claim 9 wherein said binding means comprises a separate binding ring operatively associated with each of said corresponding pairs of holes for binding an insert to said cover, said separate binding rings having a diameter at least as great as the distance between said holes in each of said corresponding pairs of holes to accommodate unfolding movement of said first cover portion to a generally flat, unfolded position.

11. The binder of claim 10 wherein said cover has a slit generally adjacent said side edge of said second cover portion and said second end of said flexible cord means has a medallion thereon, said medallion having a diameter no greater than the length of said slit in said second cover portion to pass through said slit in said second cover portion from one side to the other to be visible from said front of said binder.

12. The binder of claim 11 wherein said medallion is generally circular in shape and has a single square central aperture for securing said second end of said flexible cord means thereto, said loose ends of said cord being passed through said single square central aperture and through a loop defined by the remainder of said cord in order to form a secure looped interconnection of said cord with said medallion.

13. The binder of claim 12 wherein said corresponding pairs of holes disposed along said hole locating axes are square in shape, said slit in said cover located generally adjacent said side edge of said second cover portion has a square-shaped hole at each of opposite ends thereof, and said separate binding tings each include means for opening and closing said ring for binding said insert to said cover.

14. A binder kit, comprising:

a flexible cover having top, bottom, and a pair of opposed side edges in a flat, unfolded position and having a plurality of pairs of holes disposed along a pair of hole locating axes, said hole locating axes extending generally between said top and bottom edges in parallel relation to one another, said hole locating axes being disposed generally to one side of and parallel to a cover bisecting axis but nearer said cover bisecting axis than a nearest one of said opposed side edges of said cover;

a plurality of separate binding means each being adapted to be associated with one of said pairs of holes in said cover for binding an insert to said cover;

a flexible cord having a pair of loose ends to be secured to said cover at a point generally intermediate said opposed side edges of said cover; and a button-like fastener having a central aperture to be secured to an end of said flexible cord opposite said loose ends for cooperation with a slit in said cover.

15. The binder kit of claim 14 wherein said flexible cover is formed of a soft, pliable material to accommodate repeated folding and unfolding movement thereof.

16. The binder kit of claim 14 wherein said binding means comprise binding rings each having a diameter at least as great as the distance between said pairs of holes.

17. The binder kit of claim 14 wherein said binding means comprise binding rings each having means for opening and closing said ring for binding an insert to said cover.

18. The binder kit of claim 14 wherein said flexible cord is formed of a soft, pliable material to accommodate repeated fastener cooperation with said slit in said cover.

19. The binder kit of claim 14 wherein said button-like fastener comprises a generally circular shaped medallion having a single square central aperture therein.

20. The binder kit of claim 14 wherein said button-like fastener comprises a medallion, said binding means comprise binding rings, and said medallion and rings are formed of metal.

* * * * *

UNITED STATES PATENT AND TRADEMARK OFFICE

CERTIFICATE OF CORRECTION

PATENT NO. : 5,529,418

DATED : June 25, 1996

INVENTOR(S) : ALOTTA, Sylvia

It is certified that error appears in the above-identified patent and that said Letters Patent is hereby corrected as shown below:

column 2, line 44, replace "from" with --front--;

column 3, line 42, replace "fiat" with --flat--;

column 5, line 59, replace "dosing" with --closing--;

column 7, line 15, replace "from" with --front--; and column 8, line 58, replace "tings" with --rings--.

Signed and Sealed this

Twenty-second Day of October, 1996

*Attest:*

Bruce Lehman

BRUCE LEHMAN

*Attesting Officer*

*Commissioner of Patents and Trademarks*